United States Patent [19]

Fischer et al.

[11] 4,330,701

[45] May 18, 1982

[54] ARRANGEMENT FOR MOUNTING A SENSING BOX IN AN OPENING IN AN ELECTRIC HOT PLATE

[75] Inventors: Karl Fischer, Am Gänsberg 23, D-7519 Oberderdingen; Robert Kicherer, Knittlingen; Hans Mayer, Kürnbach, all of Fed. Rep. of Germany

[73] Assignee: Karl Fischer, Fed. Rep. of Germany

[21] Appl. No.: 107,756

[22] Filed: Dec. 27, 1979

[30] Foreign Application Priority Data

Jan. 2, 1979 [DE] Fed. Rep. of Germany ..... 290005

[51] Int. Cl.[3] ..... H05B 3/68

[52] U.S. Cl. ..... 219/450; 219/449

[58] Field of Search ..... 219/443, 445, 446, 449, 219/450, 452, 455–459, 460–467

[56] References Cited

U.S. PATENT DOCUMENTS

| | | | |
|---|---|---|---|
| 2,387,460 | 10/1945 | Meyers | 219/450 |
| 3,328,561 | 6/1967 | Sakamoto et al. | 219/450 |
| 3,674,983 | 7/1972 | Hurko et al. | 219/462 |

FOREIGN PATENT DOCUMENTS

| | | | |
|---|---|---|---|
| 259088 | 12/1967 | 01967 . | |
| 1143281 | 2/1963 | Fed. Rep. of Germany . | |
| 1229207 | 11/1966 | Fed. Rep. of Germany . | |
| 1234881 | 9/1967 | Fed. Rep. of Germany . | |
| 1565518 | 2/1970 | Fed. Rep. of Germany | 219/450 |
| 1565528 | 4/1970 | Fed. Rep. of Germany . | |
| 2013286 | 10/1971 | Fed. Rep. of Germany | 219/450 |
| 2063055 | 5/1972 | Fed. Rep. of Germany . | |
| 2326182 | 12/1974 | Fed. Rep. of Germany | 219/450 |
| 2422687 | 11/1975 | Fed. Rep. of Germany | 219/450 |
| 2515905 | 10/1976 | Fed. Rep. of Germany . | |
| 1520003 | 5/1968 | France . | |
| 342671 | 1/1960 | Switzerland . | |
| 755812 | 8/1956 | United Kingdom . | |
| 1161931 | 8/1969 | United Kingdom . | |
| 1265214 | 3/1972 | United Kingdom . | |

*Primary Examiner*—Roy N. Envall, Jr.
*Assistant Examiner*—Bernard Roskoski
*Attorney, Agent, or Firm*—Steele, Gould & Fried

[57] ABSTRACT

A mounting arrangement is provided for mounting a sensing box in an opening in an electric hot plate on which a cooking vessel is to stand. The sensing box is connected via a capillary tube to a controller and is pressed toward the cooking vessel by the force of a spring. The mounting arrangement comprises a holding member having a plurality of arms relative to which the sensing box is axially movable to a limited extent and which supports the pressing spring and holds resilient catch elements for securing the holding member on the hot plate. A spreader member limits the inward pressing of the sensing box into the opening by resting on the sensing box in its outer peripheral region. The holding member is a sheet metal member in the form of a star having a substantially flat central portion and at least four bent arms which form the catch or support arms, passages for the capillary tube connection or inlet nozzle being formed on the inner corners of the cutouts separating the arms from each other in the region of the substantially flat central portion of the holding member, the spreader stops corresponding in number to the arms of the holding member and being orientated relative to them.

11 Claims, 5 Drawing Figures

ARRANGEMENT FOR MOUNTING A SENSING BOX IN AN OPENING IN AN ELECTRIC HOT PLATE

FIELD AND BACKGROUND OF THE INVENTION

German Pat. No. 24 22 687 discloses a mounting arrangement for mounting a sensing box in an opening in an electric cooker hot plate in which the sensing box is connected via a capillary tube to a control means and is pressed toward a cooking vessel, for example, a saucepan, standing on the hot plate by the force of a spring, with a holding member, relative to which the sensing box can be moved axially to a limited extent and which supports the pressing spring and holds springy catch elements for securing the holding member on the hot plate. The holding member has a catch hoop with a central portion. The pressing spring runs transversely through the opening, abutting on the underside of the hot plate. The catch hoop also has at least two arms, which are bent away from the sensing box from the central portion, and on which the catch elements are formed. According to German Pat. No. 24 22 687, a spreader member is arranged on the catch hoop and is designed to limit the inward pressing of the sensing box into the opening by resting on the sensing box in its outer peripheral region, the spreader member being in the form of a sheet metal member provided on the central portion of the catch hoop with squared off edges directed toward the sensing box as spreader stops.

In the above mentioned German patent, the holding member consists of a catch hoop in the form of a sheet metal member in whose central portion is firmly rivetted a three-armed spreader member whose upwardly pointing arms form the spreader stops. Although this design has proven suitable in practice, it would be desirable to further increase the free spring path even in the case of very flat sensing boxes. Moreover, if mounted in an unskilled manner, the mounting arrangement would tilt obliquely in the opening in the hot plate so that it could not rest on the bottom of the saucepan in an orderly fashion. It would thus be desirable to provide increased protection from faulty mounting. However, the simple structure and, particularly, the automatic assembly of the arrangement should not be impaired but rather improved.

SUMMARY OF THE INVENTION

The object of the invention is therefore to improve the mounting arrangement described above so as to increase protection from tilting and simultaneously to make the installation of the mounting arrangement in the opening in the hot plate more reliable in operation.

According to the invention there is provided an arrangement for mounting a temperature sensing box in an opening in an electric cooking plate, through which opening the sensing box may engage a cooking vessel standing on the plate, the sensing box being connected to control means by a capillary tube and being urged toward the cooking plate by a spring, the spring being supported by a holding member, the sensing box being axially movable to a limited extent relative to the holding member, the holding member having a catch hoop for positioning and locking the holding member in place and a spreader for limiting movement of the sensing box toward the catch hoop, the holding member comprising: a first sheet metal member, forming the catch hoop, in the form of a star having a substantially flat central portion and at least four support arms, formed by cut-outs, bent away from the sensing box, at least two of the arms having catch elements for engaging corresponding structure of the cooking plate, and the cut-outs forming passages through the catch hoop; and, a plurality of sheet metal stop arms, fixed to the cental portion of the first member and directed toward the sensing box, forming the spreader, the stop arms having abutment edges for engaging the periphery of the sensing box, the number of stop arms corresponding to the number of support arms and the stop arms being oriented relative to the support arms.

Four spreader stops can be provided in the case of a holding member in the form of a four-armed star, the danger from jamming of the sensing box in the hot plate opening being virtually eliminated. Since the spreader stops have to absorb, in part, quite high forces without bending, it is advantageous that the force acting on the spreader stops can be conveyed directly onto the holding member and, by the shortest route, to the catch arms and thus onto the support on the hot plate. Passages for the capillary tube connection and the inlet nozzle remain in the corners of the cut-outs separating the catch arms.

The passages can preferably be shaped so as to form a constriction of the catch arms in the central portion region. This results in a sufficiently large passage, even though the catch arms are sufficiently wide. The resilience of the catch arms is also ensured although the holding member, consisting of a springy material, can preferably be reinforced by curving it in the region of the bent part of the catch arms and reinforcing it in the central portion by beads.

Another embodiment in which the catch arms are not interrupted by the openings yielding the material from which spreader stops is formed, the spreader stops follow the passages as bends.

The spreader stops can be sheet metal tabs which are bent up from the material of the holding member. However, it is also possible to provide a special spreader member which is fixed to the holding member, in particular to reduce the number of types in the case of differing spreader stop heights. Nevertheless, the number of spreader stops should correspond to the number of arms in each case as this ensures that the sensing box is guided on the mounting arrangement without tilting. A good distribution of forces is also produced.

An embodiment in which all arms of the holding member are catch arms is also feasible. A comparable effect with respect to the freedom from tilting is also achieved, however, if only two of the arms are catch arms and the two other arms are support arms which have outwardly pointing bends designed to rest on the associated part on the hot plate. This is normally a sleeve which is pressed into the central opening of the hot plate on whose lower rim the supporting arm can rest. Although the depth of penetration is clearly defined in this way and tilting is prevented, release can be effected using only one hand which presses the two catch arms together to uncatch. Furthermore, it is also possible to adopt this mounting arrangement in hot plates having a transversely running hoop in their central region.

The support arms also allow an inward pressing member to be arranged between them, which allows the sensing box to be inserted from beneath by the pressure of one finger, by which process automatic centering takes place.

Other advantages and features of the invention are disclosed in the description in conjunction with the drawings.

DETAILED DESCRIPTION OF THE PREFERRED EMBODIMENTS

Figure 1:
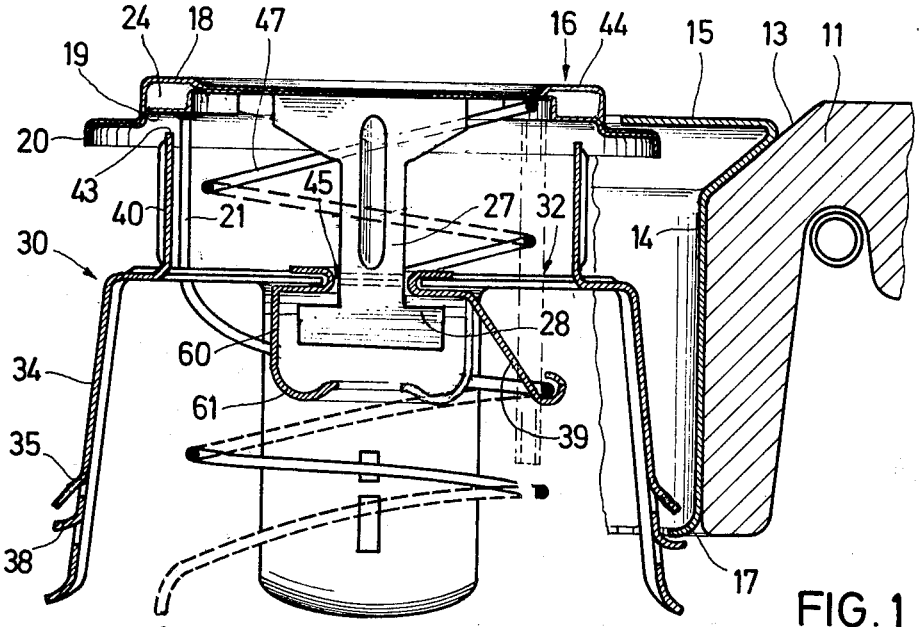
FIG. 1 shows a magnified cross-section through the central portion of an electric hot plate with a fitted sensing box.

FIG. 1 shows the central region of a conventional hot plate 11 having a central opening 13 with an upper bevel in the form of a broken edge. A sleeve 14 is pressed into this opening and is secured by upsetting its upper ends. In this region, the sleeve forms an inward pointing flange 15 through whose inner opening a sensing box 16 projects outwards. An inward pointing flange 17 which is toothed on its inward pointing edge is also molded on the lower end of the sleeve 14.

The sensing box 16 consists of an upper half dish 18 shaped from sheet metal and a lower half dish 19 whose outer rim 20 points downwards. The two half dishes 18,19 are shaped so as to form an annular chamber 24 between them which is filled with an expansion fluid and which is connected via a capillary tube 21 to a temperature regulator 22 for the hot plate, which regulator is only illustrated schematically.

Figure 2:
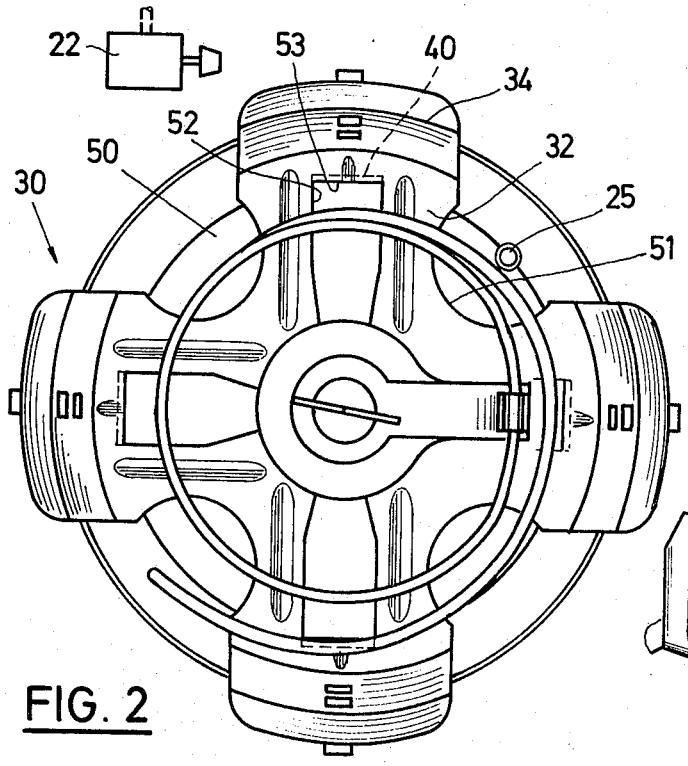
FIG. 2 shows a view of the mounting arrangement from below.

The capillary tube 21 runs axially in the connection region in the same manner as a similarly arranged inlet nozzle 25 facing the connection nozzle (FIG. 2).

A downward projecting holding member 27 consisting of a sheet metal with a hammer-like head 28 with a lower free end is soldered in the central region of the sensing box.

The hammer-like head 28 secures the stop member in an opening 45 in a holding member 30 composed of readily resilient sheet metal and, in the embodiment, is produced from a sheet metal blank in the form of a four-armed star in such a way that the four catch arms 34 which form the star and have a substantially rectangular shape are bent downwards so that the holding hoop has the shape of an inverted four-pointed crown in this region. The catch arms are curved to match the periphery on which they lie and possess a lower outward pointing chamfer so that they are well reinforced in each direction. Catch elements 35 and catch stops 38 are formed in the center thereof and cooperate with the flange 17 of the sleeve 14 in order to secure each arm positively. The catch elements 35 snap on the flange when the sensing box is pressed in from below once the arms have previously been pressed inwards somewhat by the obliqueness of the catch elements 35. The stop 38 prevent the sensing box from penetrating too deeply.

The four catch arms 34 are separated from each other by cut-outs 50 while corners lying in the generally flat central portion 32 of the holding member are designed into semi-circular passages 51 which somewhat constrict the catch arms in this central portion. As shown in FIG. 2, sufficiently large passages for the capillary tube 21 and the inlet nozzle 25 are formed in this way.

In the part of each of the catch arms 34 lying in the central portion 32 there is, centrally to the catch arm, a respective elongate cut-out 52 whose material is bent up round the outer narrow edge 53 and, reinforced by a bead, forms a spreader member 40 whose upper end forms a spreader stop 43 for the underside of the sensing box 16 which prevents the sensing box from being pressed in obliquely, for example, when a saucepan is placed on it or when it is cleaned, so far that its upper surface 44 jams beneath the flange 15 and thus puts the sensing box out of operation. A total of four spreader members 40 thus lie in an almost direct alignment with the catch arms 34 and thus readily convey the force onto them.

The central portion 32 of the holding member 30 is reinforced by a double cross-shaped bead arrangement.

A bowl-shaped inward pressing member 60 with a holding hoop 39 as a support point for the capillary tube is welded in the region of the central opening 45. The lower portion of the bowl-shaped inward pressing member which is rounded in the shape of a tire forms a pressure surface 61 which is intended to form a possible support for a finger with which the mounting arrangement is pressed into the opening in the hot plate from below. The holding hoop 39 could also be specially arranged.

The advantage of the above mentioned German patent is maintained in this invention. The helical spring 47 rests in the central portion 32 of the holding member. The central portion of the holding member separates the spring from the capillary tube arrangement, which is also wound helically, so that they cannot become entangled in each other.

Figure 3:
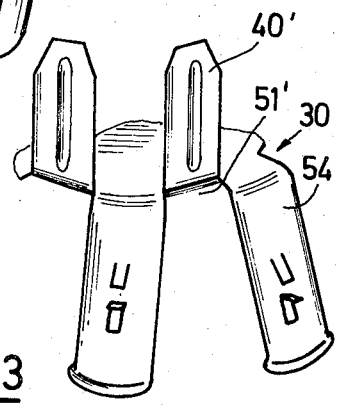
FIG. 3 shows an oblique view of a detail of a variation of the holding member.

FIG. 3 shows a variation in which the spreader members 40' are formed in the region of the passages 51'. They therefore consist of a bend of the material which forms the passages 51' and which is bent upwards round the edge of these passages pointing toward the center of the holding member. In this case, the cut-outs 52 need not be provided in the region of the catch arms but the force is not transferred directly from the spreader members to the catch arms as in the embodiment according to FIGS. 1 and 2 which is otherwise similar to the variation.

It should therefore be apparent that the invention provides a mounting arrangement which meets all practical requirements. The holding member is produced from only one sheet metal member and is held securely by the four-armed arrangement inside the central opening which is also maintained if, for example, one arm is not engaged correctly. Even so, sufficiently large passages exist between the catch arms to allow the capillary tube and the inlet nozzle to penetrate although it is possible to provide four or more spreader members which reliably prevent the sensing box from tilting and shifting beneath the flange of the sleeve in the central region of the hot plate. The desirable distribution of forces which results where pressure is applied to the spreader parts ensures high stability together with minimal material costs for material and sufficient resilience in the catch arms. Due to the presence of four catch arms, only a single catch element 35 need be provided on each catch arm so that it is easy to check whether the catch arm has also engaged when the sensing box arrangement is inserted into the hot plate region, which usually has to take place where it cannot be seen. It is also possible to provide more than four catch arms and/or spreader stops although the problem then arises of creating sufficiently large passages for the capillary tube and the inlet nozzle. The number of catch arms and spreader stops need not be equal, although the problem set out above of an inferior distribution of force can then arise.

Figure 4:
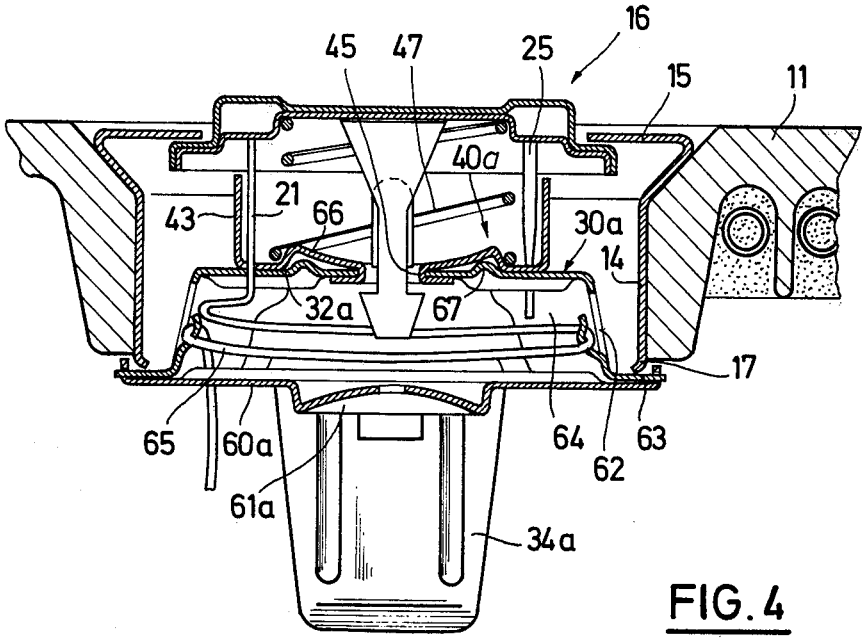
FIG. 4 shows a longitudinal section through a further preferred embodiment; and, FIG. 5 shows a plan view of the holding member of this variation without a sensing box.
Figure 5:
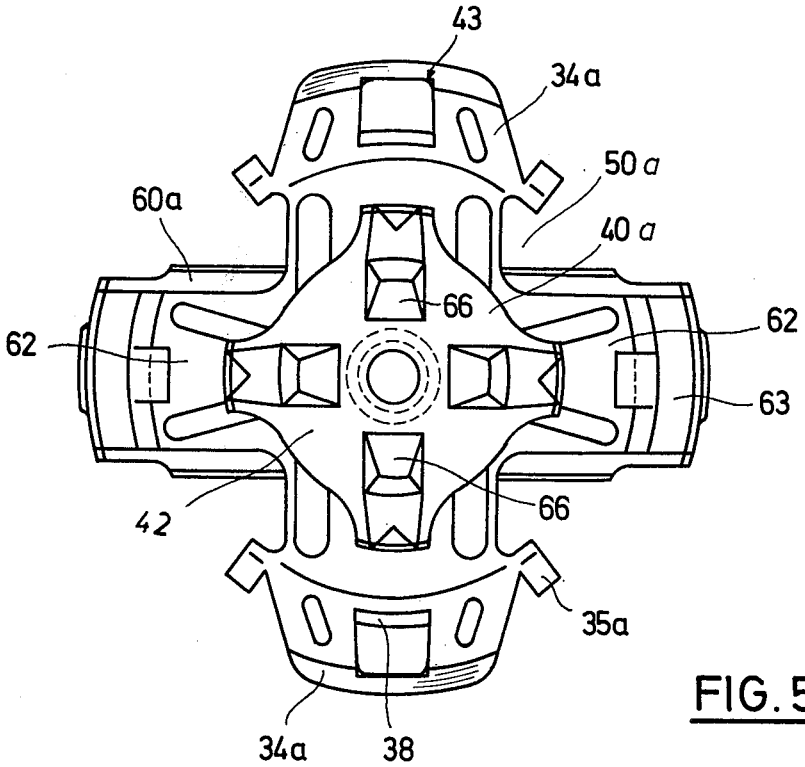

In the embodiment according to FIGS. 4 and 5, identical parts have identical reference numerals. The holding member 30*a* used therein also has four arms emanating from its central portion 32, of which only two are catch arms 34*a* however, while the two other arms are support arms 62 which each have a substantially horizontally running, outward pointing bend 63 at their free end, which can rest against the lower rim 17 of the sleeve 14 of the hot plate 11 in the mounted condition of the mounting arrangement. This is simplified by an inward pressing member 60*a* in the form of a hoop with a central pressure surface 61*a* shaped to correspond to a finger tip, the middle which is joined to the two bends 63 of the support arms 62 by engagement.

A space 64 in which the compensating windings 65 of the capillary tube 21 lie is defined between the four arms 34*a*, 62 of the central part 32*a* and the inward pressing part 60*a*, which also forms a reinforcement for the support arms 62. Like the inlet nozzle 25, the capillary tube 21 projects through the cut-outs 50*a* formed between the four arms.

The arrangement is intended for a relatively flat hot plate. The support surfaces 63 formed by the bends and the catch elements 35*a*, two of which are formed on the side edges of the catch arms 34*a* in each case, are consequently formed relatively close to the central part 32*a* of the holding member. The catch arms 34*a* do however have long, downward projecting extensions which allow them to be grasped easily with two fingers so that the arrangement can be disengaged if it is in need of repair.

A spreader member 42, produced as a separate part, is fixed by rivetting in the central region on the cental portion 32*a* of the holding member. The spreader member is produced from a sheet metal blank in the form of a four-armed star, and has a plate-like central region with four punched out areas 66 while the four arms are bent up at 90° and form the spreader stops 43. The punched out areas 66 each lie adjacent to an arm and have an upward shaped, ramp-like configuration with a steeper, outward pointing portion. They cooperate with stud-like projections 67 on the holding member and, due to their hip roof-like bevel are designed in such a way that they center themselves during assembly, i.e. before being rivetted on the holding member, in such a way that the four spreader stops 43 are orientated relative to the arms 34*a*, 62, i.e. each point in the same direction, respectively. The outermost, more steeply inclined oblique edges of the punched out area 66 guide the helical spring 57 between them so that the spring cannot tilt or jam. In this case, the helical spring is also separated from the compensating windings 65 of the capillary tube enclosed in the special chamber 64 and interference therebetween is eliminated. The windings 65 are fixed in holding tabs on the support arms 62.

Although only two catch arms are provided, a secure and non-tilting mounting is achieved in this embodiment since after the inward pressing, which is simplified by the inward pressing member 60*a*, the support surfaces 63 together with the catch elements 35 form a secure positioning both in the upward direction and in the downward direction, and tilting is prevented. Nevertheless, the catch elements can be released easily by pressing the two catch arms 34 together with two fingers. The special arrangement of the spreader member 40*a* can simplify production at varying levels, if necessary, because only one other spreader member can be used in that case and not a completely newly formed holding member.

We claim:

1. In an arrangement for mounting a temperature sensing box in an opening in an electric cooking plate, through which opening the sensing box may engage a cooking vessel standing on the plate, the sensing box being connected to control means by a capillary tube and being urged toward the cooking plate by a spring, the spring being supported by a holding member, the sensing box being axially movable to a limited extent relative to the holding member, the holding member having a catch hoop for positioning and locking the holding member in place and a spreader for limiting movement of the sensing box toward the catch hoop, the improvement wherein the holding member comprises:

a first sheet metal member, forming the catch hoop, in the form of a star having a substantially flat central portion and four support arms, formed by cut-outs, two of the arms bent away from the sensing box and having oppositely acting catch elements for interengaging corresponding structure of the cooking plate, preventing movement both toward and away from the cooking plate, and the other two of the arms being flat in the vicinity of the corresponding structure of the cooking plate except for outwardly directed bent portions which can abut the bottom of, but cannot interengage the corresponding structure of the cooking plate, only preventing movement toward the cooking plate, the cut-outs forming passages through the catch hoops; and, a plurality of sheet metal stop arms, fixed to the central portion of the first member and directed toward the sensing box, forming the spreader, the stop arms having abutment edges for engaging the periphery of the sensing box, the number of stop arms corresponding to the number of support arms and the stop arms being aligned with the support arms.

2. A mounting arrangement according to claim 1, wherein the holding member is of a resilient material which is curved in the region of the bent part of the support arms and is reinforced by beads in the central portion.

3. A mounting arrangement according to claim 1, wherein the holding member further comprises an inward pressing member with a pressure surface for manually pressing the catch elements inwardly.

4. A mounting arrangement according to claim 1, wherein the spreader comprises a second sheet metal member, having a central portion from which the stop arms project and are bent upwardly.

5. A mounting arrangement according to claim 4, wherein the spreader and catch hoop comprise intermeshing projections and recesses which align themselves during assembly.

6. A mounting arrangement according to claim 5, wherein the recesses are beads in the spreader member which form a centering means for the spring.

7. A mounting arrangement according to claim 3, wherein the support arms are joined together by the inward pressing member.

8. A mounting arrangement according to claim 1 wherein the support arms have guide surfaces running substantially in the direction of insertion.

9. In an arrangement for mounting a temperature sensing box in an opening in an electric cooking plate, through which opening the sensing box may engage a cooking vessel standing on the plate, the sensing box being connected to control means by a capillary tube and being urged toward the cooking plate by a spring, the spring being supported by a holding member, the sensing box being axially movable to a limited extent relative to the holding member, the holding member having a catch hoop for positioning and locking the holding member in place and a spreader for limiting movement of the sensing box toward the catch hoop, the improvement wherein the holding member comprises:

a first sheet metal member, forming the catch hoop, in the form of a star having a substantially flat central portion and at least four support arms, formed by cut-outs, some of the arms bent away from the sensing box and having catch elements for engaging corresponding structure of the cooking plate, and the cut-outs forming passages through the catch hoop; and, a second sheet metal member having a central portion from which a pluralityof stop arms project and are bent upwardly toward the sensing box, forming the spreader, the stop arms having abutment edges for engaging the periphery of the sensing box, the number of stop arms corresponding to the number of support arms and the stop arms being oriented relative to the support arms, the spreader and catch hoop having intermeshing and self-aligning projections and recesses, the recesses formed by beads in the spreader which form a centering means for the spring.

10. In an arrangement for mounting a temperature sensing box in an opening in an electric cooking plate, through which opening the sensing box may engage a cooking vessel standing on the plate, the sensing box being connected to control means by a capillary tube and being urged toward the cooking plate by a spring, the spring being supported by a holding member, the sensing box being axially movable to a limited extent relative to the holding member, the holding member having a catch hoop for positioning and locking the holding member in place and a spreader for limiting movement of the sensing box toward the catch hoop, the improvement wherein holding member comprises:

a first sheet metal member, forming the catch hoop, in the form of a star having a substantially flat central portion and at least four support arms, formed by cut-outs, some of the arms bent away from the sensing box and having catch elements for engaging corresponding structure of the cooking plate, and the cut-outs forming passages through the catch hoop;

a plurality of sheet metal stop arms, fixed to the central portion of the first member and directed toward the sensing box, forming the spreader, the stop arms having abutment edges for engaging the periphery of the sensing box, the number of stop arms corresponding to the number of support arms and the stop arms being oriented relative to the support arms; and, an inward pressing member with a pressure surface for manually pressing the catch elements together, the support arms being joined together by the inward pressing member.

11. A mounting arrangement according to claim 10, wherein the inward pressing member defines a chamber for accommodating a compensating winding of the capillary tube between it and the holding member.

* * * * *

UNITED STATES PATENT AND TRADEMARK OFFICE

CERTIFICATE OF CORRECTION

PATENT NO. : 4,330,701

DATED : May 18, 1982

INVENTOR(S) : Karl Fischer et al

It is certified that error appears in the above-identified patent and that said Letters Patent are hereby corrected as shown below:

Column 5, line 41, "cental" should read --central--.

Column 5, line 58, "57" should read --47--.

Column 7, line 31, "pluralityof" should read --plurality of--.

Signed and Sealed this

*Third* Day of *August 1982*

[SEAL]

*Attest:*

GERALD J. MOSSINGHOFF

*Attesting Officer* *Commissioner of Patents and Trademarks*